US006092260A

United States Patent [19]

Kai

[11] Patent Number: 6,092,260

[45] Date of Patent: Jul. 25, 2000

[54] HAND-HELD BLOWER

[75] Inventor: Nobuto Kai, Fuchu, Japan

[73] Assignee: Ryobi North America, Inc., Anderson, S.C.

[21] Appl. No.: 09/059,449

[22] Filed: Apr. 13, 1998

Related U.S. Application Data

[60] Provisional application No. 60/044,666, Apr. 18, 1997.

[51] Int. Cl.[7] ..... A47L 7/00

[52] U.S. Cl. ..... 15/320; 15/330; 15/344; 362/96; 362/120; 239/135; 239/289; 239/351; 239/355

[58] Field of Search ..... 15/320, 322, 327.7, 15/344, 347, 330; 239/135, 289, 346, 351, 355, 369, 8, 9, 152, 153, 128, 132, 133; 132/112, 117, 118, 119.1; 34/96, 97; 362/96, 89, 91, 109, 119, 120

[56] References Cited

U.S. PATENT DOCUMENTS

| | | | |
|---|---|---|---|
| 2,517,882 | 8/1950 | Johnson . | |
| 2,588,000 | 3/1952 | Hines . | |
| 2,613,995 | 10/1952 | Reinhold . | |
| 2,753,434 | 7/1956 | Storm, Jr. . | |
| 2,969,559 | 1/1961 | Landis . | |
| 3,774,255 | 11/1973 | Pao | 15/3.53 |
| 4,085,309 | 4/1978 | Godel et al. | 392/384 |
| 4,291,839 | 9/1981 | Brett | 239/289 |
| 4,734,017 | 3/1988 | Levin | 417/366 |
| 4,936,027 | 6/1990 | Tsuji | 34/90 |
| 4,945,604 | 8/1990 | Miner et al. | 15/344 |
| 4,978,072 | 12/1990 | Kurowski | 239/346 |
| 4,993,639 | 2/1991 | Hata | 239/289 |
| 5,105,497 | 4/1992 | Haque | 15/3.53 |
| 5,131,598 | 7/1992 | Hoogeveen, Jr. | 239/223 |
| 5,195,253 | 3/1993 | Poumey et al. | 34/97 |
| 5,241,974 | 9/1993 | Tsai | 132/272 |
| 5,794,303 | 8/1998 | Sanfilippo et al. | 15/344 |
| 5,839,204 | 11/1998 | Cinque et al. | 34/97 |

*Primary Examiner*—William H. Beisner
*Attorney, Agent, or Firm*—Brooks & Kushman P.C.

[57] ABSTRACT

A hand-held blower mechanism includes an elongated housing having an inlet and outlet, and having a nozzle portion at the outlet. A motor is positioned within the housing along a central drive axis which intersects the inlet and the outlet. A centrifugal fan is positioned within the housing adjacent the inlet and is driven by the motor about the drive axis. A reservoir is removably secured to the nozzle portion with a tube in fluid communication with the outlet to facilitate spraying of fluid from the reservoir as air is blown through the outlet by the fan. Various attachments are provided.

19 Claims, 4 Drawing Sheets

HAND-HELD BLOWER

CROSS-REFERENCE TO RELATED APPLICATION

This application claims benefit of U.S. Provisional Application Serial No. 60/044,666, filed Apr. 18, 1997, which is hereby incorporated by reference.

TECHNICAL FIELD

The present invention relates to hand-held blowers, and more particularly to a hand-held mechanism adaptable for use as an air brush, sprayer, heater, or vacuum.

BACKGROUND OF THE INVENTION

Typically, air brushes for use in painting include a wand which is attached to a pneumatic hose, which is connected to an air compressor. The wand includes valves for selectively spraying paint under force provided by the compressor. In order to assure clean air, a filter must be used to filter any oils or debris carried from the compressor.

The above-described air brush assembly can be a very expensive and cumbersome unit, and may not be conducive to work in certain environments, such as air brushing large objects, because a long pneumatic hose and powerful compressor would be required.

Accordingly, it is desirable to provide a hand-held air brush which does not require a compressor or pneumatic hose. It is further desirable to provide a hand-held air brush which is convertible for use as a vacuum, heater, blower, sprayer, and brush cleaner.

DISCLOSURE OF THE INVENTION

The present invention overcomes the above-referenced shortcomings of prior art air brushes by providing a hand-held blower including a battery operated motor for driving a centrifugal fan within a housing. The housing is adapted to receive a removable fluid reservoir for adapting the blower as an air brush or fluid sprayer. The housing is further adapted to receive a heater unit for adapting the blower as a heater, a vacuum unit for adapting the blower as a vacuum, and a brush for use as a brush cleaner.

More specifically, the present invention provides a hand-held blower mechanism including an elongated housing having an inlet and an outlet with a nozzle portion at the outlet. A motor is positioned within the housing along a central drive axis which intersects the inlet and the outlet. A centrifugal fan is positioned within the housing adjacent the inlet and is driven by the motor about the drive axis. The nozzle portion is adapted to receive a fluid reservoir for adapting the blower mechanism as a fluid sprayer. Various attachments are provided for the blower mechanism.

The hand-held blower unit of the present invention further comprises a clear plastic nozzle and light for lighting work areas. The blower unit also includes a charging connection for battery charging, and an electrical connection for power-cord connection.

Compressed air is maintained in the interior of the housing by a centrifugal fan, and high speed blowing is achieved through a narrow air nozzle secured to the end of the housing. The centrifugal fan may be cone-shaped in vertical cross-section for enhanced flow.

The hand-held blower provides blower speed adjustability by providing a tail cap with flow openings alignable with flow openings formed in the rear of the housing.

DETAILED DESCRIPTION OF THE PREFERRED EMBODIMENTS

Figure 1:
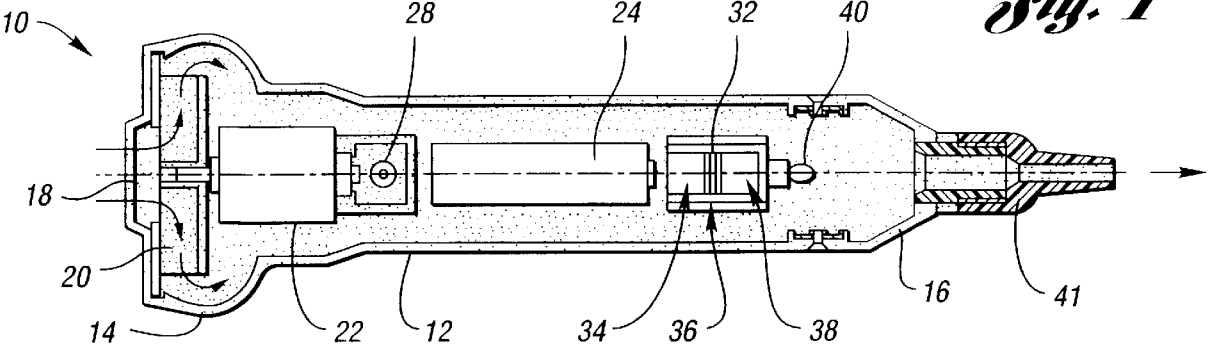
FIG. 1 is a vertical cross-sectional view of a hand-held blower apparatus in accordance with the present invention.
Figure 2:
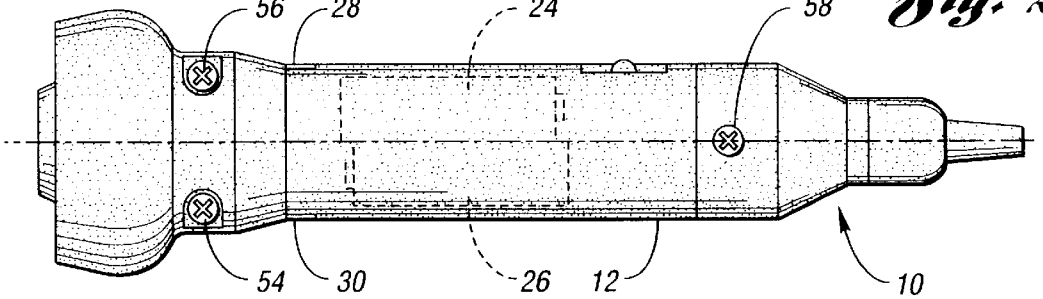
FIG. 2 is a side view of the blower apparatus of FIG. 1.

Referring to FIGS. 1 and 2, a blower apparatus 10 is shown in accordance with the present invention. As shown, the blower apparatus 10 includes an elongated housing 12 disposed along a central axis (or drive axis) 11. The housing has first and second ends 14,16, respectively.

The first end 14 of the housing 12 is provided with an opening 18 for allowing air to be drawn therethrough by the centrifugal fan 20, which is driven by the motor 22. A pair of NiCd batteries 24,26 are provided for driving the motor 22, and a charging connection 28 is provided for battery charging. Additionally, an optional power cord connection 30 is provided for extra energy.

A switch 32 is provided for movement between a first position 34 in which the motor 22 is on, a second position 36 (illustrated in FIG. 1) in which the motor 22 is off, and a third position 38 in which the motor 22 and light 40 are both on. The light 40 is provided for lighting work areas through the clear plastic nozzle 41.

Figure 5:
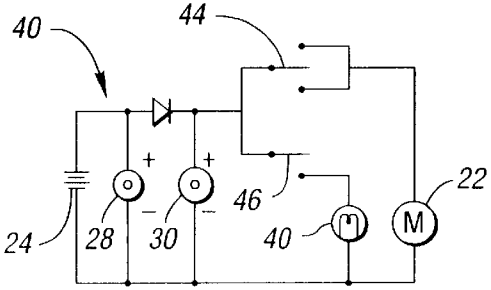
FIG. 5 is a motor control schematic for use with the blower apparatus shown in FIG. 1.

FIG. 5 shows a control schematic 42 for use with the blower apparatus 10. The schematic includes first and second contact plates 44,46 which selectively connect the motor 22 and light 40 with the battery 24, and with the charging connection 28 and power cord connection 30 when the switch 32 is operated.

Accordingly, when the motor 22 is on, the centrifugal fan 20 pressurizes air within the housing 12, and the air accelerates through the nozzle 41 at the second end 16 of the housing 12 for blowing.

Figure 4:
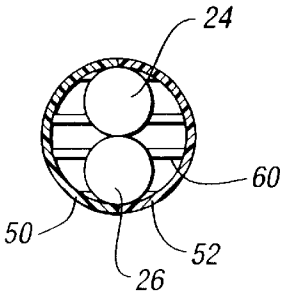
FIG. 4 is a vertical cross-sectional view of the blower apparatus shown in FIG. 1.

As shown in FIGS. 2 and 4, the housing 12 preferably comprises opposing clam shell halves 50,52 secured by screws 54, 56, 58, and including support ribs 60, which support the batteries 24,26.

Figure 3:
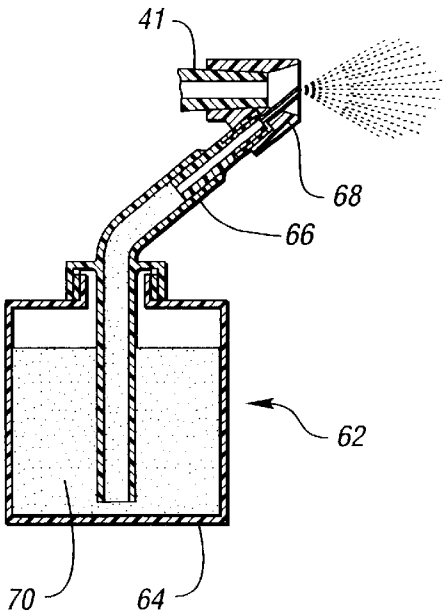
FIG. 3 is a partial cross-sectional view of a fluid reservoir attached to the blower apparatus of FIG. 1.

Turning to FIG. 3, a reservoir unit 62 including a tank 64 and tube 66, is shown for attachment to the blower apparatus or use as an air brush or fluid sprayer. The tube 66 is attachable to the nozzle 41 of the blower apparatus by means of the attachment device 68. As shown, the tank 64 is adapted to carry fluid 70 therein, such as paint, cleaning oil, water, farm chemicals, etc., such that the Bernoulli affect of air blowing through the nozzle draws the fluid 70 through the tube 66 such that the fluid 70 is sprayed by the blower apparatus 10, as illustrated in FIG. 3.

Figure 6:
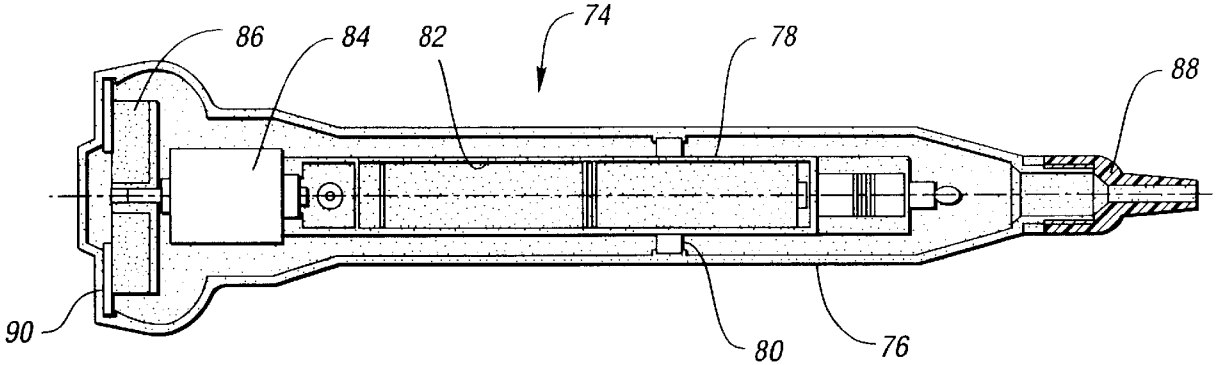
FIG. 6 is a longitudinal vertical cross-section of a blower apparatus in accordance with an alternative embodiment of the present invention.
Figure 7:
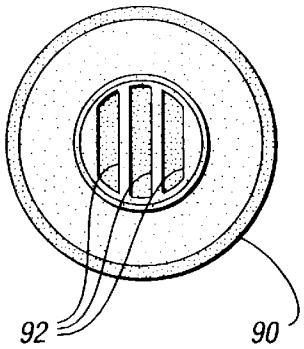
FIG. 7 is an end view of the blower apparatus shown in FIG. 6.

Referring to FIGS. 6 and 7, an alternative embodiment of the present invention is shown. In this embodiment, the blower apparatus 74 includes an elongated housing 76 with an inner housing 78 supported within the outer housing 76 by means of the support structure 80. The inner housing 78 includes a storage area 82 for end-to-end storage of batteries for driving the motor 84. The apparatus 74 further includes a centrifugal fan 86 and nozzle 88 for facilitating blowing operations. As shown in FIG. 7, the end portion 90 includes a plurality of openings 92 formed therethrough to facilitate air flow through the housing. By positioning the batteries end-to-end rather than side-by-side within the housing, air flow may be enhanced.

Figure 11:
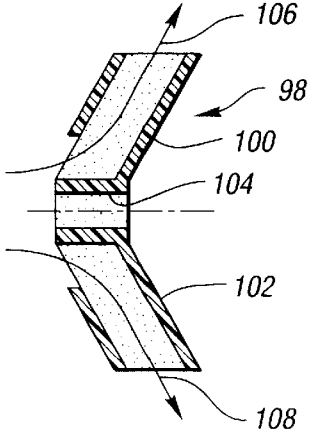
FIG. 11 is a cross-sectional view of the centrifugal fan shown in FIG. 10.
Figure 10:
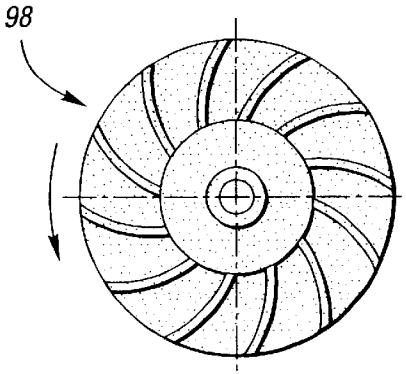
FIG. 10 is a plan view of a centrifugal fan in accordance with a second alternative embodiment of the present invention.
Figure 9:
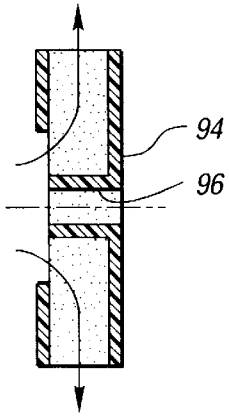
FIG. 9 is a cross-sectional view of the centrifugal fan shown in FIG. 8.
Figure 8:
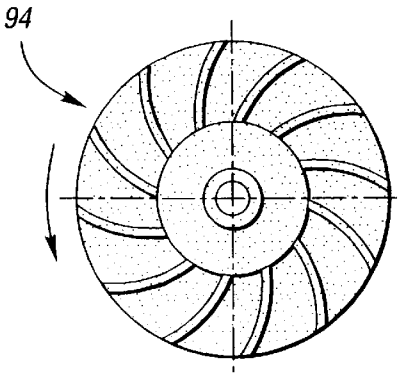
FIG. 8 is a plan view of a centrifugal fan for use with the present invention.

Turning to FIGS. 8–11, alternative centrifugal fans are illustrated. The centrifugal fan 94 illustrated in FIGS. 8 and 9 directs air flow radially with respect to the central aperture 96 of the fan 94. FIGS. 10 and 11 illustrate a cone-form centrifugal fan 98, which includes side walls 100,102 which are angled with respect to the central aperture 104 such that air blown angularly, as illustrated by arrows 106,108. Alternatively, an axial fan or piston pump could be used. The cone-form centrifugal fan may be most effective for efficiently flowing air in the interior of the housing.

Figure 12:
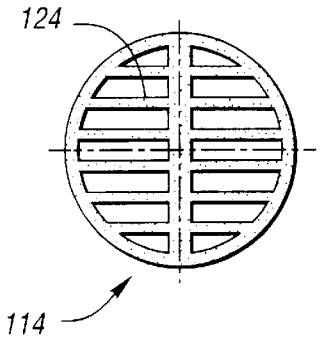
FIG. 12 is an end view of a heater unit adapted for attachment to the blower apparatus of FIG. 1.
Figure 13:
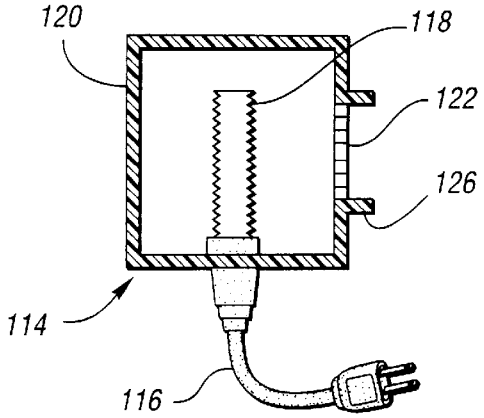
FIG. 13 is a cross-sectional view of the heater unit shown in FIG. 12.
Figure 14:
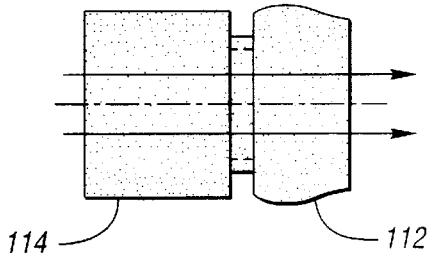
FIG. 14 shows a schematically arranged side view of the heater unit of FIG. 12 attached to the blower apparatus of FIG. 1.
Figure 15:
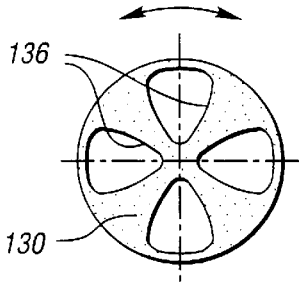
FIG. 15 shows an end view of a tail cap adapted for attachment to the blower apparatus of FIG. 1.
Figure 16:
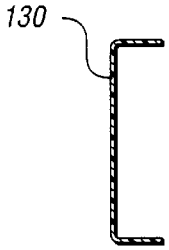
FIG. 16 shows a vertical cross-sectional view of the tail cap of FIG. 15.
Figure 17:
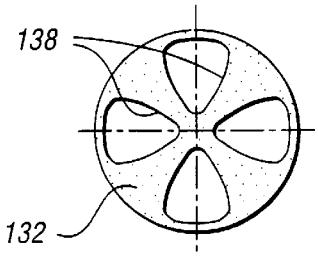
FIG. 17 shows an end view of an end portion of a blower apparatus housing in accordance with a third alternative embodiment of the present invention.
Figure 18:
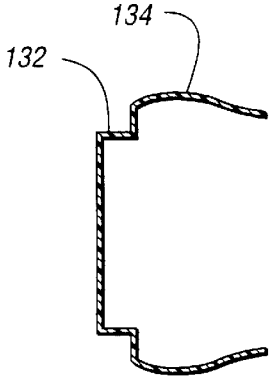
FIG. 18 shows a schematic side profile of an end portion of a blower apparatus in accordance with the embodiment shown in FIG. 17.

As shown in FIGS. 12–14, the blower apparatus housing 112 is further adapted to receive a heater unit 114 in order to heat air flowing through the blower apparatus. The heater unit 114 includes a power cord connection 116 and a heating element 118. The heating element 118 is disposed within a housing 120 for heating air which is drawn through openings 122,124 in the housing 120. As shown in FIG. 13, the housing 120 includes an attachment portion 126 for attachment onto the rear end of the housing 112 adjacent the centrifugal fan.

As shown schematically in FIGS. 15–18, a tail cap 130 may be provided for attachment onto the end portion 132 of the blower apparatus housing 134 (corresponding with housing 12 shown in FIG. 1). As shown, the tail cap 130 includes apertures 136 formed therein for cooperation with the apertures 138 formed in the end portion 132 of the housing for adjusting air flow. The tail cap 130 may be rotated to place the apertures 136,138 in respective alignment. Air speed may be increased or decreased by adjusting alignment of the apertures 136,138, respectively.

Figure 19:
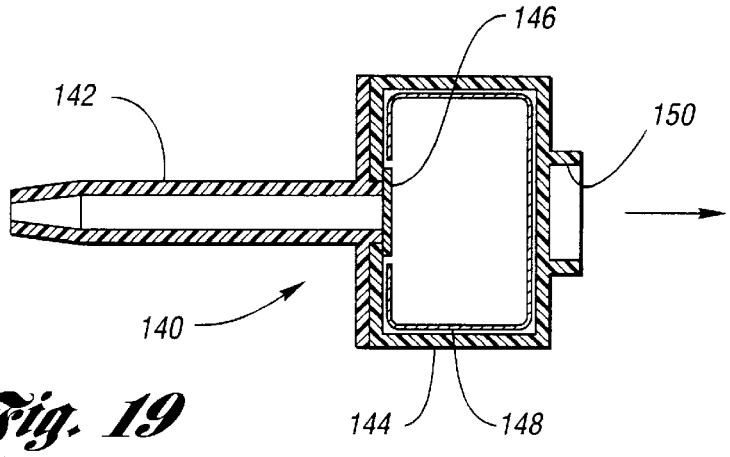
FIG. 19 shows a schematic cross-sectional view of a vacuum unit adapted for attachment to the blower apparatus shown in FIG. 1.
Figure 20:
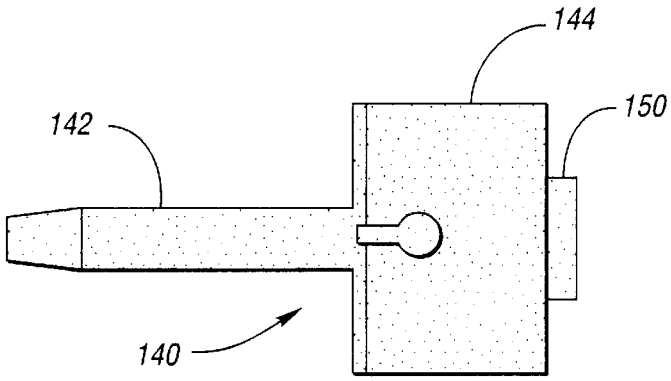
FIG. 20 shows a side view of the vacuum unit of FIG. 19.

Turning to FIGS. 19 and 20, the present invention also provides a vacuum unit 140 including a cleaning wand 142 and a debris collection housing 144 for attachment to the blower apparatus. A valve 146 is between the wand 142 and the debris collection housing 144 for selectively allowing passage of debris into the paper bag 148 within the debris collection housing 144. The debris collection housing 144 further includes an attachment portion 150 for attachment onto the rear end of the housing 12 adjacent the centrifugal fan so that air may be drawn through the wand 142, through the debris collection housing 144, through the attachment portion 150, and into the blower apparatus housing 12 to facilitate debris collection in the bag 148. When using the blower apparatus as a vacuum cleaner, removing the air nozzle 41 will increase air flow through the apparatus.

Figure 21:
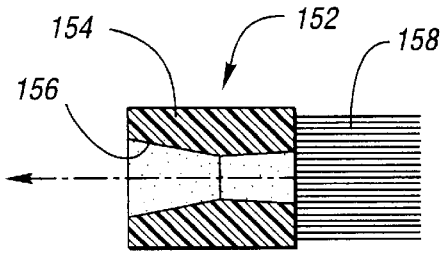
FIG. 21 shows a schematic longitudinal cross-sectional view of a brush cap adapted for attachment to the blower apparatus of FIG. 1.
Figure 22:
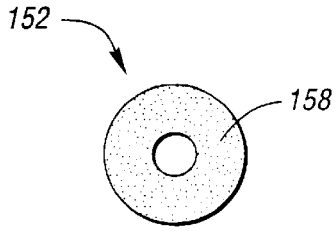
FIG. 22 shows an end view of the brush cap of FIG. 21.

FIGS. 21 and 22 illustrate a cleaner brush 152 which includes a nozzle attachment 154 adapted for attachment to the nozzle 41 of the blower apparatus 10, shown in FIG. 1. The nozzle attachment 154 includes a cone-shaped aperture 156 to facilitate attachment to the nozzle 41. A brush 158 is provided on the nozzle attachment 154 for cleaning computer keyboards, displays, etc. as air is blown through the nozzle attachment 154.

While the best modes for carrying out the invention have been described in detail, those familiar with the art to which this invention relates will recognize various alternative designs and embodiments for practicing the invention within the scope of the appended claims.

What is claimed is:

1. A hand-held blower mechanism, comprising:

a housing having an inlet and outlet, and having a nozzle portion at the outlet;

a light positioned within the housing adjacent the nozzle portion for shining light through the nozzle portion to illuminate a workpiece;

a motor positioned within the housing; and a fan positioned within the housing adjacent the inlet and driven by the motor for directing air from the inlet to the outlet;

wherein the nozzle portion is adapted to receive a fluid reservoir for adapting the blower mechanism as a fluid sprayer.

2. The hand-held blower mechanism of claim 1, further comprising a battery disposed within the housing centrally mounted with respect to the inlet and outlet of the housing adjacent the motor for driving the motor.

3. The hand-held blower mechanism of claim 1, wherein said nozzle portion comprises a clear plastic material.

4. The hand-held blower mechanism of claim 1, further comprising a reservoir secured to the nozzle portion with a tube in fluid communication with the outlet to facilitate spraying of fluid from the reservoir as air is blown through the outlet by the fan.

5. The hand-held blower mechanism of claim 1, further comprising a heater unit removably attached to the inlet of the housing for adapting the blower mechanism as a heater.

6. The hand-held blower mechanism of claim 1, further comprising a vacuum unit removably attached to the inlet of the housing for adapting the blower mechanism as a vacuum, wherein said nozzle portion is removably attached to the outlet of the housing to increase the air flow rate through the housing.

7. The hand-held blower mechanism of claim 1, further comprising a brush adapted for connection to the nozzle portion.

8. The hand-held blower mechanism of claim 1, further comprising an electrical connector in electrical communication with the motor for power cord attachment.

9. The hand-held blower mechanism of claim 1, wherein said fan comprises a centrifugal fan which is generally cone-shaped in vertical cross-section.

10. The hand-held blower mechanism of claim 1, wherein said housing forms a plurality of flow openings at said inlet, and further comprising a tail cap removably attached to the housing at the inlet, said tail cap including apertures therein that are adjustably alignable with said flow openings for adjustment of air speed through the housing.

11. A hand-held blower mechanism, comprising:

an elongated housing having an inlet and outlet, and having a nozzle portion at the outlet;

a light positioned within the housing along a drive axis adjacent the nozzle portion for shining light through the nozzle portion to illuminate a workpiece;

a motor positioned within the housing along a drive axis which intersects the inlet and the outlet;

a centrifugal fan positioned within the housing adjacent the inlet and driven by the motor about the drive axis; and a reservoir removably secured to the nozzle portion with a tube in fluid communication with the outlet to facilitate spraying of fluid from the reservoir as air is blown through the outlet by the fan.

12. The hand-held blower mechanism of claim 11, further comprising a battery positioned within the housing along a drive axis centrally mounted with respect to the inlet and outlet of the housing adjacent the motor for driving the motor.

13. The hand-held blower mechanism of claim 11, wherein said nozzle portion comprises a clear plastic material.

14. The hand-held blower mechanism of claim 11, further comprising a heater unit removably attached to the inlet of the housing for adapting the blower mechanism as a heater.

15. The hand-held blower mechanism of claim 1, further comprising a vacuum unit removably attached to the inlet of the housing for adapting the blower mechanism as a vacuum, wherein said nozzle portion is removably attached to the outlet of the housing to increase the air flow rate through the housing.

16. The hand-held blower mechanism of claim 11, further comprising a brush adapted for connection to the nozzle portion.

17. The hand-held blower mechanism of claim 11, further comprising an electrical connector in electrical communication with the motor for power cord attachment.

18. The hand-held blower mechanism of claim 11, wherein said fan comprises a centrifugal fan which is generally cone-shaped in vertical cross-section.

19. The hand-held blower mechanism of claim 11, wherein said housing forms a plurality of flow openings at said inlet, and further comprising a tail cap removably attached to the housing at the inlet, said tail cap including apertures therein that are adjustable alignable with said flow openings for adjustment of air speed through the housing.

* * * * *